US006275994B1

(12) United States Patent
Lewis et al.

(10) Patent No.: US 6,275,994 B1
(45) Date of Patent: Aug. 21, 2001

(54) ROPE-CARRYING GARMENT

(75) Inventors: Patricia Lewis, Huber Heights; William L. Grilliot; Mary I. Grilliot, both of Dayton, all of OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 09/677,642

(22) Filed: Oct. 3, 2000

(51) Int. Cl.[7] ..... A41D 1/02
(52) U.S. Cl. ..... 2/94; 2/108
(58) Field of Search ..... 2/69, 94, 108, 2/456, 247, 250, 81, 85, 227, 79, 97, 253, 254, 312; 182/3–6; 244/143, 151 R; 224/223, 256, 251, 230, 255, 910, 904

(56) References Cited

U.S. PATENT DOCUMENTS

| | | | | |
|---|---|---|---|---|
| 4,613,068 | * | 9/1986 | Bianchi | 224/242 |
| 4,836,427 | * | 6/1989 | McManus | 224/224 |
| 5,127,565 | * | 7/1992 | Grant | 224/196 |
| 5,199,621 | * | 4/1993 | McLennan | 224/253 |
| 5,370,288 | * | 12/1994 | Field | 224/223 |
| 5,970,517 | * | 10/1999 | Jordan | 2/69 |
| 6,134,713 | * | 10/2000 | De Rosa et al. | 2/94 |

* cited by examiner

*Primary Examiner*—John J. Calvert
*Assistant Examiner*—Tejash Patel
(74) *Attorney, Agent, or Firm*—Rockey, Milnamow & Katz, Ltd.

(57) ABSTRACT

A garment for a firefighter, a rescue worker, a forestry worker, or another worker having to carry a rope of a given diameter when unstressed, the garment has an expanse of fabric and two elastic bands are fastened, which are spaced from each other. Each band is fastened to the expanse of fabric by a series of spaced rows of stitches, which define a series of sleeves. Each sleeve is defined by an associated portion of the expansive region of the garment and by an associated portion of a respective one of the elastic bands. Each sleeve is adapted elastically to stretch at the associated portion of the respective one of the elastic bands so as snugly to hold two lengths of a rope. Each sleeve is adapted readily to release the lengths held by such sleeve when the rope is pulled from such sleeve. When the garment is equipped with a rope, the rope is arranged in a zig-zag pattern defining a series of loops, each loop having two lengths of the rope and a bight joining the lengths of such loop. The loops are tucked through the sleeves in a common direction so that each loop is tucked through an associated one of the sleeves at one said band and through an associated one of the sleeves at the other band, so that the bights are disposed beyond the associated one of the sleeves at the latter band, and so that the lengths are held snugly by the sleeves at each band until the rope is pulled in an opposite direction so as to cause the sleeves to release the rope.

6 Claims, 1 Drawing Sheet

FIG. 1
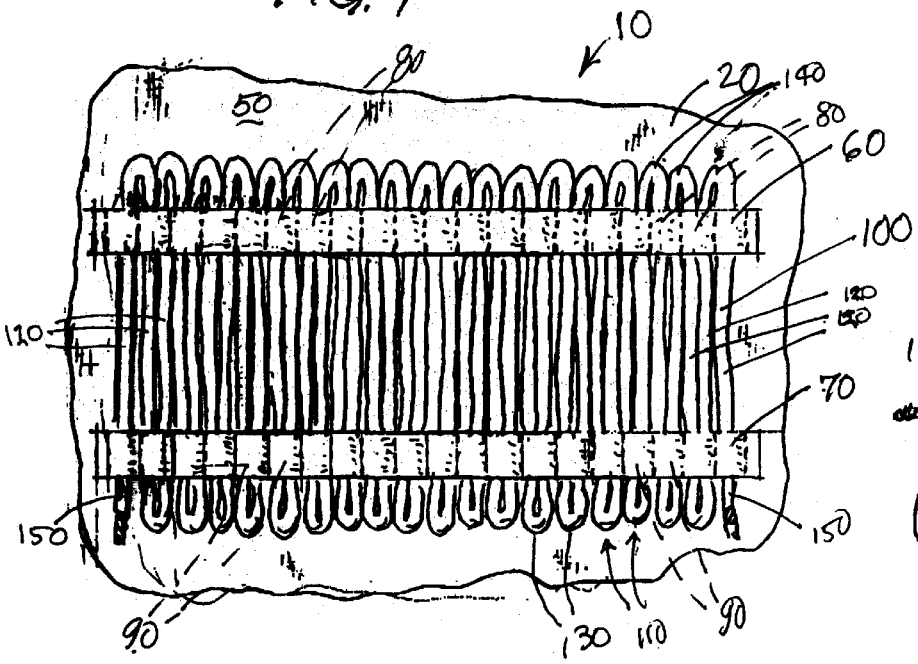
FIG. 2
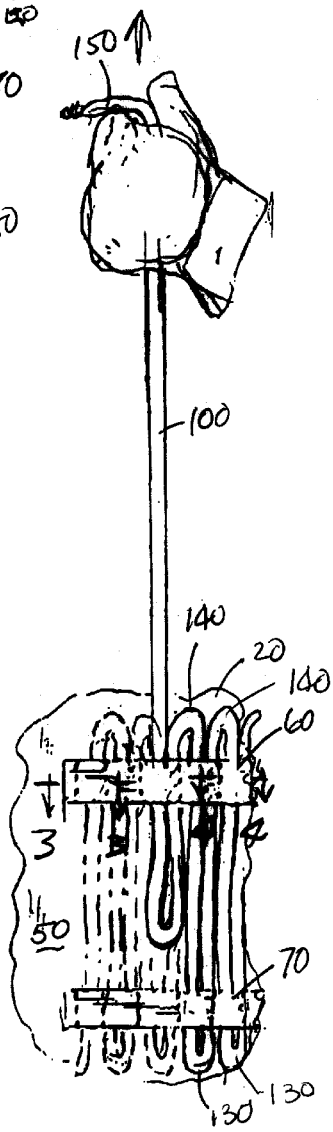
FIG. 3
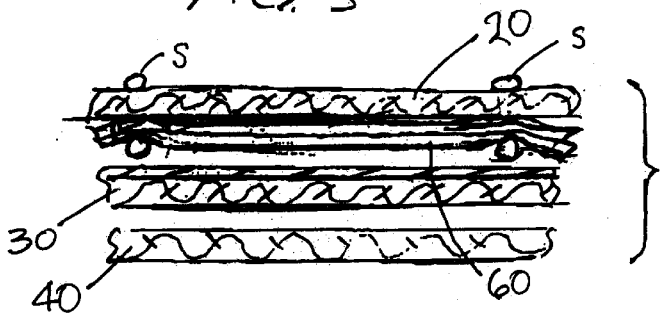
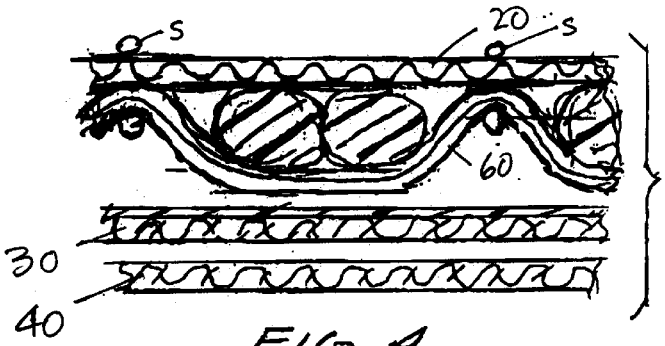
FIG. 4

ROPE-CARRYING GARMENT

TECHNICAL FIELD OF THE INVENTION

This invention pertains to a garment for a firefighter, a rescue worker, a forestry worker, or another worker having to carry a rope. As improved by this invention, the garment has elastic means adapted snugly to hold a rope but readily to release the rope when the rope is pulled.

BACKGROUND OF THE INVENTION

Commonly, firefighters, rescue workers, and other workers, such as construction workers and forestry workers, are equipped with bulky, heavy ropes, which they must carry in their hands or on their shoulders while walking, climbing, or working. Such ropes tend to imbalance the firefighters or other workers who have to carry such ropes. A need has been recognized, which was addressed in U.S. Pat. No. 6,012,167 and to which this invention is addressed, for a better way for such workers to carry bulky, heavy ropes without becoming imbalanced, while freeing their hands.

The inventors named herein are aware that another party made a recent attempt to address the need by fastening two strips of an essentially inelastic fabric to an inner surface of a back portion of an outer body of a coat for a firefighter, the outer body having been made from a similarly inelastic fabric, by fastening the strips so as to define an upper series of sleeves and a lower series of sleeves, and by instructing a user to insert loops of the rope through sleeves of the upper series and through sleeves of the lower series. The inventors named herein believe, however, that the recent attempt was unsuccessful because the rope could not be readily removed.

SUMMARY OF THE INVENTION

This invention provides an improved garment, such as a coat, vest, or jacket, for a firefighter, a rescue worker, a forestry worker, or another worker having to carry a rope. The garment has an expanse of fabric, such as an expanse of fabric on an inner surface of a back portion of an outer body of a coat for a firefighter, and an elastic band, which is fastened to the expanse of fabric by a series of spaced fastenings defining a series of sleeves. Preferably, the fastenings are non-metallic fastenings, such as rows of stitches. Alternatively, the fastenings are metallic fastenings, such as rivets.

Each sleeve is defined by an associated portion of the expanse of fabric and by an associated portion of the elastic band, each sleeve being adapted elastically to stretch at the associated portion of the elastic band so as snugly to hold two lengths of a rope until the rope is pulled from said sleeve and so as readily to release the lengths held by said sleeve when the rope is pulled from said sleeve. Preferably, the rope does not cross itself in any of the loops or between the loops.

Preferably, the garment is equipped with a rope arranged in a zig-zag pattern defining a series of loops, each loop having two lengths of the rope and a bight joining the lengths of the rope in said loop. The loops are tucked through the sleeves in a common direction, each loop being tucked through an associated one of the sleeves, so that the lengths of so that bights joining the lengths of the rope in the loops are disposed beyond the sleeves, and so that the lengths of the rope in the loops are held snugly by the sleeves until the rope is pulled in the opposite direction so as to cause the sleeves to release the rope.

In a preferred embodiment, two elastic bands spaced from each other, each elastic band being fastened by a series of spaced fastenings defining a series of such sleeves. Moreover, the garment is equipped with a rope arranged in a zig-zag pattern defining a series of loops, each loop having two lengths of the rope and a bight joining the lengths of the rope in said loop. Furthermore, the loops are tucked through the sleeves in a common direction, each loop being tucked through an associated one of the sleeves at one said band and through an associated one of the sleeves at the other band, so that the bights joining the lengths of the rope in the loops are disposed beyond the associated one of the sleeves at the latter band, and so that the lengths of the rope in the loops are held snugly by the sleeves at each elastic band until the rope is pulled in an opposite direction so as to cause the sleeves to release the rope.

BRIEF DESCRIPTION OF THE DRAWINGS

FIG. 1 is a fragmentary, elevational view of a garment, such as a firefighter's coat, as equipped with a rope pursuant to this invention.

FIG. 2 is a fragmentary, elevational view, as shown in FIG. 1 except that the rope is being removed.

FIG. 3 is a fragmentary, sectional view taken along line 3—3 in FIG. 2, in a direction indicated by arrows.

FIG. 4 is a fragmentary, sectional view taken along line 4—4 in FIG. 2, in a direction indicated by arrows.

DETAILED DESCRIPTION OF THE PREFERRED EMBODIMENT

As illustrated, a garment 10 equipped with a rope 100 constitutes a preferred embodiment of this invention. As shown, the garment 10 is a firefighter's coat having an outer body 20, a moisture barrier 30, and a thermal liner 40. Details of the outer body 20, the moisture barrier 30, and the thermal liner 40 are outside the scope of this invention. Rather than a firefighter's coat, the garment 10 may be a garment 10 may be a coat, vest, or jacket for a rescue worker, a forestry worker, or another worker having to carry a rope, such as the rope 100.

Preferably on an inner surface of a back portion of the outer body 20, or alternatively on an outer surface of the back portion of the outer body 20 or elsewhere, the garment 10 has an expanse 50 of an essentially inelastic fabric, an upper band 60 of an elastic fabric, and a lower band 70 of an elastic fabric. The upper band 60 is fastened to the fabric expanse 50 by a series of rows of stitches S so as to define a series of sleeves 80. Each sleeve 80 is defined by an associated portion of the fabric expanse 50 and by an associated portion of the upper band 60. The lower band 70 is fastened to the fabric expanse 50 by a series of rows of stitches S so as to define a series of sleeves 90. Each sleeve 90 is defined by an associated portion of the expanse 50 of fabric and by an associated portion of the lower band 80.

The rope 100 is arranged in a zig-zag pattern defining a series of loops 110. Each loop 110 has two lengths 120 of the rope 100, a bight 130 joining the lengths 120 of the rope 100 in said loop 110, and a bight 140 joining each loop 110 with an adjacent loop 110. Each sleeve 80 is adapted elastically to stretch at the upper band 60 so as snugly to hold one length 120 of the rope 100, as near each end 150 of the rope 100, or two lengths 110 of the rope 100 until the rope 100 is pulled from said sleeve 80. Each sleeve 90 is adapted elastically to stretch at the lower band 70 so as snugly to hold one length 120 of the rope 100, as near each end 150 of the rope 100, or two lengths 120 of the rope 100 until the rope 100 is pulled from said sleeve 90, as illustrated in FIG. 2.

The loops 11 0 are tucked through the sleeves 80, 90, in a common direction, e.g. downwardly as illustrated in FIG. 1. Each loop 100 is tucked initially through an associated one of the sleeves 80 at the upper band 60 and subsequently through an associated one of the sleeves 90 at the lower band 70, so that the bights 130 joining the lengths 120 of the rope 100 in the loops 110 are disposed beyond the associated one of the sleeves 90 at the lower band 70, and so that the lengths 120 of the rope 100 in the loops 110 are held snugly by the sleeves 80, 90, until the rope 100 is pulled in an opposite direction, e.g. upwardly as illustrated in FIG. 2, so as to cause the sleeves 80, 90, to release the rope 100. When pulled in the opposite direction, the rope 100 may be grasped at one of its ends 150, as illustrated, or at one of the bights 140 joining each loop 110 with an adjacent loop 110.

What is claimed is:

1. A garment for a firefighter, a rescue worker, a forestry worker, or another worker having to carry a rope, the garment having an expanse of fabric and having an elastic band, which is fastened to the expanse of fabric by a series of spaced fastenings defining a series of sleeves, each sleeve being defined by an associated portion of the expanse of fabric and by an associated portion of the elastic band, each sleeve being adapted elastically to stretch at the associated portion of the elastic band so as snugly to hold two lengths of a rope until the rope is pulled from said sleeve and so as readily to release the lengths held by said sleeve when the rope is pulled from said sleeve, wherein the garment is equipped with a rope arranged in a zig-zag pattern defining a series of loops, each loop having two lengths of the rope and a bight joining the lengths of the rope in said loop, wherein the loops are tucked through the sleeves in a common direction, each loop being tucked through an associated one of the sleeves, so that the bights joining the lengths of the rope in the loops are disposed beyond the sleeves, and so that the lengths of the rope in the loops are held snugly by the sleeves until the rope is pulled in the opposite direction so as to cause the sleeves to release the rope.

2. The garment of claim 1 wherein the rope does not cross itself in any of the loops or between the loops.

3. A garment for a firefighter, a rescue worker, a forestry worker, or another worker having to carry a rope, the garment having an expanse of fabric and having two elastic bands spaced from each other, each elastic band being fastened by a series of spaced fastenings defining a series of sleeves, each sleeve being associated with one said band and being defined by an associated portion of the expanse of fabric and by an associated portion of said one band, each sleeve being adapted elastically to stretch at the associated band so as snugly to hold two lengths of a rope until the rope is pulled from said sleeve and so as readily to release the lengths held by said sleeve when the rope is pulled from said sleeve, wherein the garment is equipped with a rope arranged in a zig-zag pattern defining a series of loops, each loop having two lengths of the rope and a bight joining the lengths of said loop, wherein the loops are tucked through the sleeves in a common direction, each loop being tucked through an associated one of the sleeves at one said band and through an associated one of the sleeves at the other band, so that the bights joining the lengths of the rope in the loops are disposed beyond the associated one of the sleeves at the latter band, and so that the lengths of the rope in the loops are held snugly by the sleeves at each elastic band until the rope is pulled in an opposite direction so as to cause the sleeves to release the rope.

4. The garment of claim 3 wherein the rope does not cross itself in any of the loops or between the loops.

5. The garment of claim 1, 2, 3, or 4 wherein the fastenings are non-metallic.

6. The garment of claim 1, 2, 3, or 4 wherein the fastenings are rows of stitches.

* * * * *